US006328254B1

(12) United States Patent
Holder

(10) Patent No.: US 6,328,254 B1
(45) Date of Patent: Dec. 11, 2001

(54) HONEYCOMB SHAPED SPOOL HOLDER FOR SEWING MACHINES

(76) Inventor: Jamisetta Holder, 3868 Louisiana, Gary, IN (US) 46409

( * ) Notice: Subject to any disclaimer, the term of this patent is extended or adjusted under 35 U.S.C. 154(b) by 0 days.

(21) Appl. No.: 09/565,527

(22) Filed: May 5, 2000

Related U.S. Application Data

(63) Continuation-in-part of application No. 09/175,528, filed on Oct. 20, 1998, now abandoned.

(51) Int. Cl.[7] ..... B65H 75/18; B65H 16/04; B65H 49/18; B65H 49/26

(52) U.S. Cl. ..... 242/597.5; 242/597.7; 242/139; 112/302

(58) Field of Search ..... 242/597.5, 597.7, 242/139, 118.31, 606; 112/302, 259, 231

(56) References Cited

U.S. PATENT DOCUMENTS

| | | | | |
|---|---|---|---|---|
| 218,428 | * | 8/1879 | Carroll | 242/597.7 |
| 416,292 | * | 12/1889 | Fowler | 242/597.7 X |
| 458,431 | * | 8/1891 | Sidebottom | 242/597.7 X |
| 924,891 | * | 6/1909 | Curfew et al. | 242/597.7 X |
| 2,069,944 | * | 2/1937 | Dunlap | 242/118.32 |
| 3,561,698 | * | 2/1971 | Steffenini | 242/118.31 |
| 3,856,229 | * | 12/1974 | Byram | 242/606 X |
| 4,254,917 | * | 3/1981 | Okamura et al. | 242/606 |
| 4,667,896 | * | 5/1987 | Frey et al. | 242/118.41 |
| 5,513,820 | * | 5/1996 | Meyer | 242/118.31 X |
| 5,626,302 | * | 5/1997 | Hrobar | 242/597.7 X |
| 5,694,873 | * | 12/1997 | Wu | 112/302 |

FOREIGN PATENT DOCUMENTS

| | | | | |
|---|---|---|---|---|
| 91/01262 | * | 2/1991 | (WO) | 242/597.5 X |

* cited by examiner

*Primary Examiner*—Donald P. Walsh
*Assistant Examiner*—Minh-Chau Pham
(74) *Attorney, Agent, or Firm*—Goldstein Law Offices P.C

(57) ABSTRACT

A honeycomb shaped spool holder for use with sewing machines having at least one upstanding spool support spindle, comprising an inner cylindrical hub which has a central bore extending therethrough for vertically receiving the spindle of a sewing machine in such a manner as to permit the holder to freely rotate thereabout as the thread is dispensed. The spool holder further comprises an outer member having an overall truncated conical configuration sized and shaped to frictionally engage the interior surfaces of a cone shaped spool core, and has a plurality of partition walls extending in an axial direction between the inner hub and the outer member such that a spoke or honeycomb pattern is formed. The partition walls help to sufficiently strengthen the structure of the spool holder, so that the spool holder can withstand a wide range of dynamic forces that may be applied thereto while it rotates at a high angular velocity about the spindle as the thread is drawn from the thread spool.

3 Claims, 2 Drawing Sheets

HONEYCOMB SHAPED SPOOL HOLDER FOR SEWING MACHINES

CROSS REFERENCES AND RELATED SUBJECT MATTER

This application is a continuation-in-part of U.S. patent application Ser. No. 09/175,528, filed in the United States Patent Office on Oct. 20, 1998, now abandoned.

BACKGROUND OF THE INVENTION

This invention relates to a spool holder for sewing machines. More particularly, the invention relates to a honeycomb shaped spool holder for holding a cone shaped thread about a spindle on a sewing machine.

A variety of thread holders have been proposed for use with sewing machines, and some in particular have been designed specifically for holding industrial sized serger threads, that are commonly available wound around a cone shape spool. Typically, spool holders tend to jump up and wobble as the spool holders rotate at a high angular velocity as the thread is dispensed from the spool. The preexisting spool holders suffer from various disadvantages in that such spool holders generally have weak construction and have a tendency to easily crack or break during use. Therefore, it is highly desirable to have an improved spool holder which is highly durable in construction, capable of withstanding a wide range of dynamic forces that may be experienced during a sewing operation. The present invention addresses this problem by providing a honeycomb shaped spool holder having an inner cylindrical hub, an outer conical member, and a plurality of partition walls extending in an axial direction therebetween in such manner as to sufficiently reinforce its overall structure to resist breakage during normal operations.

While these units mentioned above may be suitable for the particular purpose employed, or for general use, they would not be as suitable for the purposes of the present invention as disclosed hereafter.

SUMMARY OF THE INVENTION

It is an object of the invention to provide a honeycomb shaped spool holder which is simple in construction to minimize manufacturing costs and thereby making it available for the average consumer.

It is another object of the invention to provide a honeycomb shaped spool holder having an inner cylindrical hub, an outer conical member, and a plurality of partition walls extending in an axial direction therebetween in such manner as to sufficiently reinforce its overall structure to resist breakage during normal operations.

It is yet another object of the invention to provide a honeycomb shaped spool holder which has an overall truncated conical exterior configuration sized and shaped to frictionally engage with the interior surfaces of a cone shaped spool core.

The invention is a honeycomb shaped spool holder for use with sewing machines having at least one upstanding spool support spindle, comprising an inner cylindrical hub which has a central bore extending therethrough for vertically receiving the spindle of a sewing machine in such a manner as to permit the holder to freely rotate thereabout as the thread is dispensed. The spool holder further comprises an outer member having an overall truncated conical configuration sized and shaped to frictionally engage the interior surfaces of a cone shaped spool core, and has a plurality of partition walls extending in an axial direction between the inner hub and the outer member such that a spoke or honeycomb pattern is formed. The partition walls help to sufficiently strengthen the structure of the spool holder, so that the spool holder can withstand a wide range of dynamic forces that may be applied thereto while it rotates at a high angular velocity about the spindle as the thread is drawn from the thread spool.

To the accomplishment of the above and related objects, the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
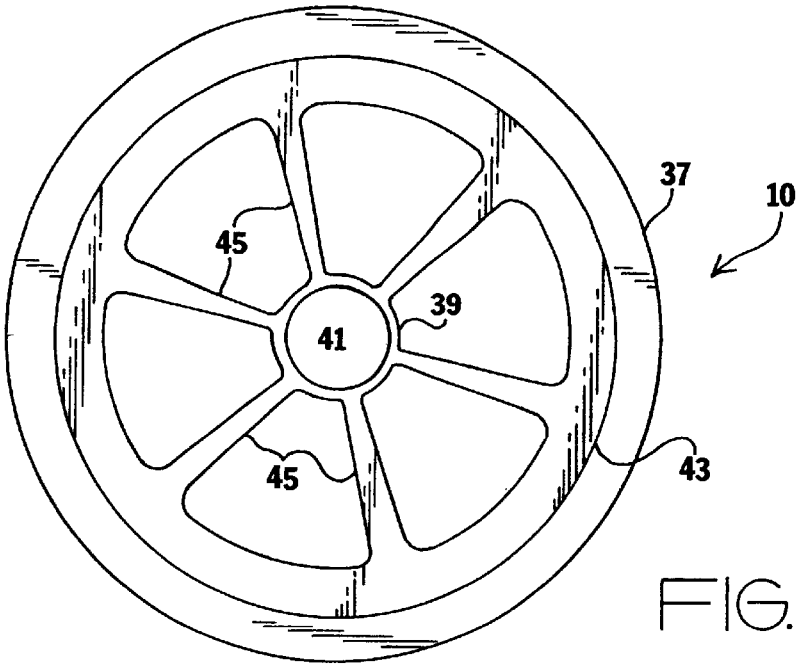
FIG. 1 is a diagrammatic perspective view of a preferred embodiment of a honeycomb shaped spool holder in accordance with the principles of the present invention.
Figure 2:
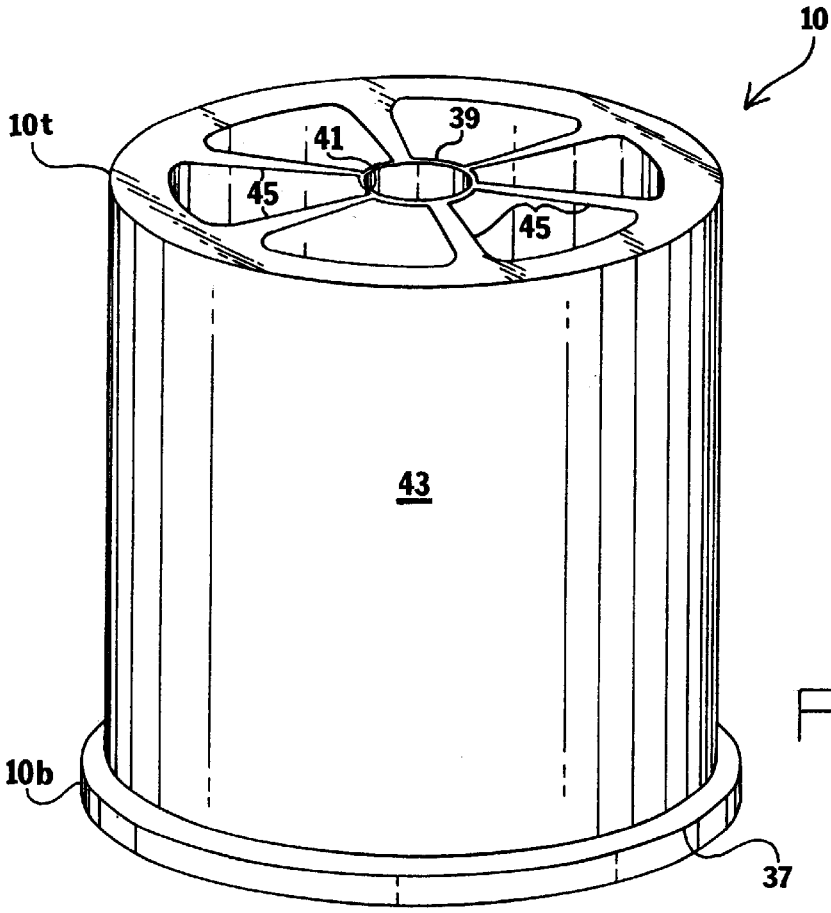
FIG. 2 is a top plan view of the honeycomb shaped spool holder of the present invention.
Figure 3:
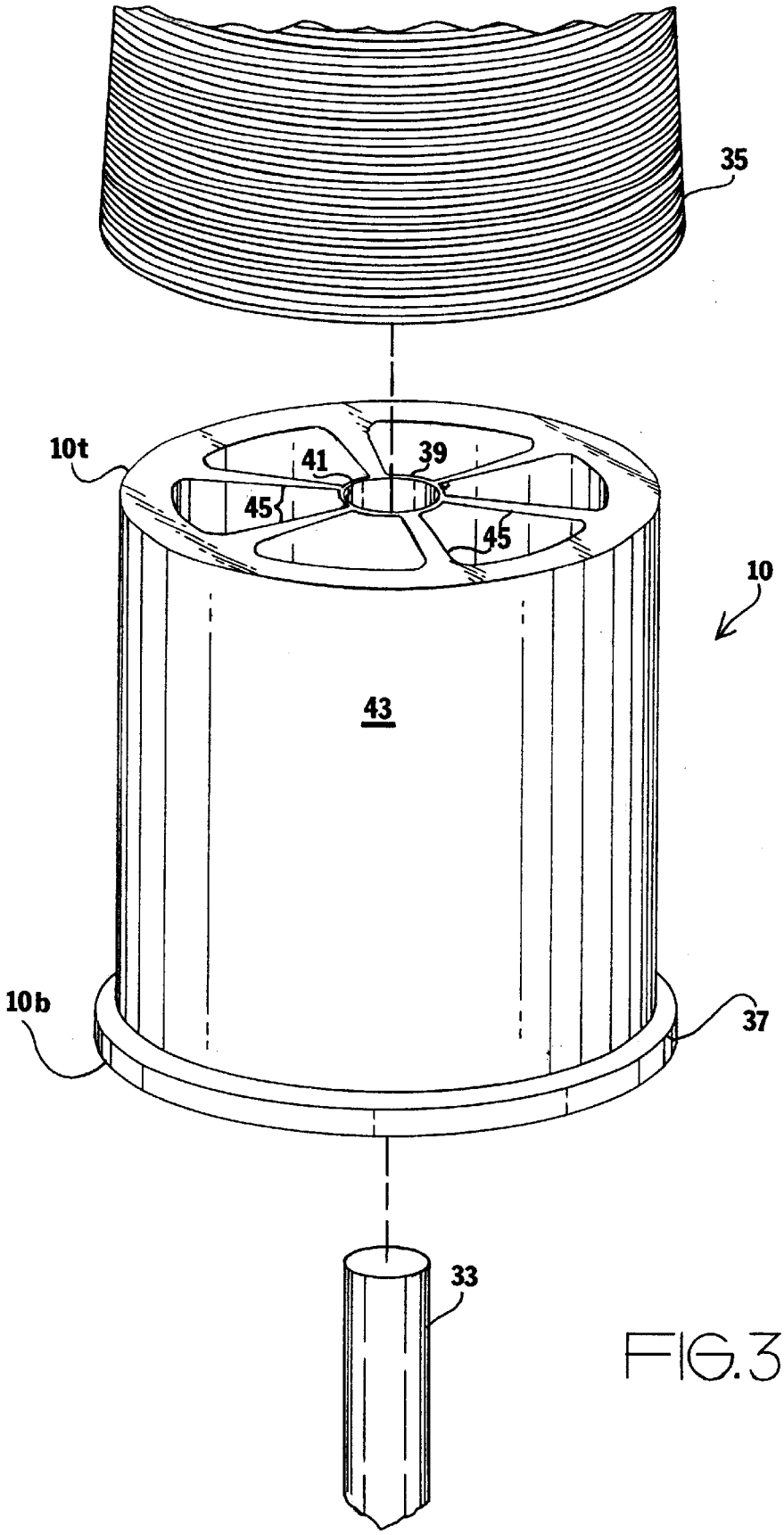
FIG. 3 is an exploded view of the present invention being used with a conventional sewing machine, illustrating from top to bottom, a cone shaped thread, the honeycomb shaped spool holder, and an upstanding spool support spindle.

FIGS. 1 and 2 illustrate a preferred embodiment of a honeycomb shaped spool holder 10 in accordance with the principles of the present invention. For a better understanding of the present invention, an upstanding spool support spindle 33 is illustrated in FIG. 3 extending upward from a base plate (not shown) for holding sewing threads. As will be seen in the following paragraphs, the spool holder 10 of the present invention is designed to holding conventional sewing threads 35 that are typically available wound around cone shaped spools.

The honeycomb shaped spool holder 10 presents a bottom end 10B for direction toward a sewing machine and a top end 10T for direction away from the sewing machine, wherein the top end 10T has a slightly smaller diameter than that of the bottom end 10B so as to create a truncated conical exterior configuration. The spool holder 10 has a flange 37 extending radially about the bottom end 10B of the spool holder for retaining a sewing thread 35 thereon. The spool holder 10 is open at the top end 10T—there is no flange at said top end 10T. The spool holder 10 includes an inner cylindrical hub 39 having a central bore 41 extending therethrough for vertically receiving the spindle 33 of a sewing machine. The central bore 41 of the spool holder 10 is sized to allow the holder to freely rotate about the spindle 33 as the thread is dispensed from the spool.

The spool holder 10 also includes an outer member 43 having an overall truncated conical shape configured for frictionally engaging with the interior surfaces of a cone shaped spool core. A plurality of partition walls 45 extends in an axial direction between the inner hub 39 and the outer member 43 such that a honeycomb or spoke pattern is formed, as seen in FIG. 2. The partition walls 45 help to sufficiently strengthen the spool holder 10, so that it can resist a wide range of dynamic forces that may be applied while the spool holder 10 rotates at a high angular velocity about the spindle 33, as the thread is drawn from the spool. The spool holder 10 can be constructed of plastic or any other suitable light and durable material.

The operation of the honeycomb shaped spool holder 10 will now be described. The honeycomb shaped spool holder is vertically mounted on a sewing machine by extending an upstanding spool support post 33 thereof through the central bore 41 of the spool holder. Whereupon, a cone shaped thread 35 is placed over the spool holder 10 mounted about the upstanding support post 33. In this manner, the cone shaped thread and the honeycomb shaped spool holder will rotate together about the spindle while dispensing thread. Because the spool holder has a highly durable construction, it will not break or crack during usage thereof and may remain on the spindle at all times.

Many specific details contained in the above description merely illustrate some preferred embodiments and should not be construed as a limitation on the scope of the invention. Many other variations are possible.

What is claimed is:

1. A honeycomb shaped spool holder for holding a thread spool having a hollow cone shaped core about an upstanding spool support spindle, comprising:

a) an inner cylindrical hub having a central bore extending therethrough for vertically receiving the spindle;

b) an outer member having an exterior configured for frictionally engaging with interior surfaces of the hollow core, having a top end and a bottom end, the outer member having a flange extending radially about the bottom end of the outer member for retaining a thread spool thereon, the top end is open and therefore has no flange; and c) a plurality of partition walls extending in an axial direction between the inner hub and the outer member such that a spoke pattern is formed, and thereby strengthening the overall construction thereof to resist a wide range of dynamic forces that may be applied while the holder rotates at a high angular velocity as the thread is drawn from the thread spool.

2. The honeycomb shaped spool holder as recited in claim 1, wherein the central bore of the hub is sized to permit the holder to freely rotate about the spindle as thread is dispensed from the thread spool.

3. The honeycomb shaped spool holder as recited in claim 1, wherein the spool holder is constructed of plastic material.

* * * * *